US005548864A

United States Patent [19]

Vosbikian et al.

[11] Patent Number: 5,548,864

[45] Date of Patent: Aug. 27, 1996

[54] TUBE AND BIASED DRIFT PIN COMBINATION AND DUSTPAN INCORPORATING SAME

[75] Inventors: Peter Vosbikian, Cinnaminson, N.J.; Haig Vartanian, Cheltenham, Pa.

[73] Assignee: Quickie Manufacturing Corporation, Cinnaminson, N.J.

[21] Appl. No.: 380,300

[22] Filed: Jan. 30, 1995

[51] Int. Cl.[6] ..... A47L 13/52; B25G 3/38

[52] U.S. Cl. ..... 15/257.7; 15/144.1; 15/145; 294/53.5; 403/91; 403/103; 403/329

[58] Field of Search ..... 15/144.1, 144.3, 15/144.4, 145, 257.7; 294/53.5; 403/84, 91, 92, 95, 103, 104, 329

[56] References Cited

U.S. PATENT DOCUMENTS

| | | | |
|---|---|---|---|
| 261,894 | 8/1882 | Albers . | |
| 529,562 | 11/1894 | Mortenson . | |
| 588,595 | 8/1897 | Nolan | 403/329 |
| 601,678 | 4/1898 | Richter . | |
| 1,006,427 | 10/1911 | Boraks | 403/104 |
| 1,500,132 | 7/1924 | Hummelgard . | |
| 1,810,026 | 6/1931 | Moller . | |
| 1,989,810 | 2/1935 | Kregeloh . | |
| 2,501,940 | 3/1950 | Hibbard | 403/329 |
| 3,018,502 | 1/1962 | Lossius | 15/257.2 |
| 3,426,367 | 2/1969 | Bradford | 403/329 |
| 3,456,663 | 7/1969 | Blum . | |
| 3,492,772 | 2/1970 | Bergman | 403/329 |
| 3,603,628 | 9/1971 | Smith et al. | 403/329 |
| 4,247,216 | 1/1981 | Pansini | 15/145 |
| 4,584,735 | 4/1986 | Garber | 15/257.7 |
| 5,285,855 | 2/1994 | Bojar | 172/377 |

FOREIGN PATENT DOCUMENTS

| | | |
|---|---|---|
| 542248 | 1/1932 | Germany . |
| 687044 | 1/1940 | Germany . |

*Primary Examiner*—Mark Spisich
*Attorney, Agent, or Firm*—Stuart M. Goldstein

[57] ABSTRACT

A tube is combined with a biased drift pin arrangement, which combination is useful for locking functions in coupling and decoupling separate tubes, or in locking-hinged dustpans, and so on. The tube has a wall formed with a pair of holes. The drift pin is formed on a leaf spring that has a base portion and a cantilever portion joined to the base portion for relative flexion therebetween. It is the cantilever portion that is formed with the drift pin, as well as a spaced push pin. The leaf spring inserts in the tube such that the drift and push pins are aligned to extend and retract through respective ones of the pair of holes. To wedge the leaf spring in place, a separate cartridge is sized and shaped to permit sliding insertion in to where respective abutment surfaces of the leaf spring and cartridge, respectively, mate each other. Thus the cartridge wedges the base portion of the leaf spring relatively immobile against the tube wall, such that the push and drift pins are normally biased to extend through the respective ones of the holes. The leaf spring is prevented from moving axially in the tube by the fact of the push pin constantly occupying its respective hole for all angles of flexion and extension of the cantilever portion. The leaf spring further is arranged to hold the cartridge captive in its stationary position. In use, the push pin is depressible to actuate or induce full retraction of the drift pin.

16 Claims, 3 Drawing Sheets

TUBE AND BIASED DRIFT PIN COMBINATION AND DUSTPAN INCORPORATING SAME

BACKGROUND OF THE INVENTION

1. Field of the Invention

The invention relates to a tube in which, near at least one end of the tube, there is arranged a retractable, radially-protruding pin extending out from a hole in the tube wall adjacent the at least one end. Such a pin, so-called a drift pin, is useful for, among other uses, locking functions in a locking hinged-dustpan arrangement or in coupling and decoupling separate tubes, and so on.

2. Prior Art

Biased drift pin arrangements, including arrangements which are not inserted in tubes, are known in widely divergent fields of endeavor. Typical examples of biased drift pin arrangements not especially used in association with tubes but deployed nevertheless in various locking applications include the pair of snow shovels disclosed separately in U.S. Pat. No. 2,098,609—Bishop and U.S. Pat. No. 4,264,095—Lemasters, or the spray-nozzle support in U.S. Pat. No. 1,989,810—Kregeloh. Other examples of biased drift pin arrangements, this time inserted inside tubes, include locking hinged-dustpans as disclosed in German Patent No. 542,248—Bickenbach (Dec. 31, 1931) and in commonly-owned, commonly-invented U.S. Pat. No. 5,367,737—Vosbikian.

Despite the wide spread popularity in biased drift pin arrangements, and including particularly tube and drift pin combinations, room for improvement still exists. The present invention involves structures arranged in ways to provide advantages in which the tube and drift pin combination as a whole is made from relatively more economical materials, which are more economically formable into elaborate shapes, and are more economically assembled together to a finally-assembled biased drift-pin arrangement that is comparably functional to the prior art arrangements disclosed above but presumably much more durable and less likely to fail.

SUMMARY OF THE INVENTION

It is an object of the invention to provide a tube and biased drift pin combination which excludes the need for direct mechanical fastening via welds, adhesives, or rivets and the like.

It is an alternative object of the invention to have the drift pin carried on a cantilever-mounted leaf spring which is used in a substantially planar state, putting aside relatively small angles of flexion.

It is an additional object of the invention that the above leaf spring be wedged relatively firmly in position by a separate cartridge which can be made from a relatively inexpensive material that is inexpensively formable into a relatively elaborate shape to achieve a cartridge configuration advantageous for inexpensive assembly with the leaf spring.

It is another object of the invention to arrange the leaf spring and cartridge to cooperatively stabilize themselves in a proper position in the tube.

These and other aspects and objects are provided according to the invention in a combination of a tube and biased drift pin. The tube has a wall extending between opposite end portions, one of which is formed with two axially-spaced holes. The drift pin is formed in a leaf spring which provides the biasing action. The leaf spring has a base portion and a cantilever portion joined to the base portion for relative flexion between the base and cantilever portions. The base portion is formed with an abutment surface. The cantilever portion is formed with the drift pin, as well as a spaced push pin. The combination tube and biased drift pin includes a separate cartridge that is formed with its own abutment surface.

To assemble, the leaf spring is positioned in the tube with the drift and push pins aligned to extend and retract through respective ones of the axially-spaced holes. The cartridge is sized and shaped to permit sliding insertion of it in the tube, relative to the leaf spring, to a stationary position where the respective abutment surfaces are mated. In such position, the cartridge wedges the base portion of the leaf spring relatively immobile against the tube wall such that the push and drift pins are normally biased to extend through the respective holes.

In use, the push pin can be depressed to induce full retraction of the drift pin. Thus, one exemplary use of the tube and biased drift pin combination 10 includes an arrangement for coupling separate tubes together. That is, one tube is fitted with the biased drift pin arrangement as described, while the other tube is formed to carry a short segment of sleeve sized to allow the tube with the biased drift pin to telescope therein The sleeve is formed with one hole for removably receiving the biased drift pin. In accordance with such arrangement, the separate tubes can be coupled and decoupled together in a fashion similar as plug and socket, or rod and ferrule, by activating the drift pin via the push pin.

Another exemplary use for the tube and biased drift pin combination occurs as a locking hinged-dustpan. The locking hinged-dustpan 60 comprises an elongated tubular handle pivoted to a dust pan, with the biased drift pin arrangement inserted in the handle adjacent the dust pan to provide for locking the dust pan and handle in various angularly-different positions. The above exemplary are given for convenience in this description and do not limit the uses of the tube and biased drift pin combination to the given examples only.

An inventive aspect concerns the arrangement of the leaf spring by which it is maintained from moving axially in the tube. To this end, the push pin is positioned such that it constantly occupies its respective hole for all angles of flexion and extension of the cantilever portion. Other aspects of the leaf spring relate to a pair retaining lips or catches that are placed to retain the cartridge in that one relatively stationary position.

The cartridge has a body extending between opposite edges. One of these edges defines the abutment surface for the cartridge. The other edge acts on, or is acted on by, the retaining means of the leaf spring. As a result, the cartridge is captive between the retaining means and abutment surface that are both on the leaf spring.

The wedging action between the cartridge and leaf spring is accomplished in the following way. The base portion of the leaf spring is elongated and generally planar between opposite lateral edges. The cartridge is formed with a flat surface to abut against the base portion. The flat surface is sized to induce the wedging of the base portion against the tube by inducing the lateral edges thereof against the tube wall.

An inventive aspect concerns fabricating the cartridge from an inexpensive material that is inexpensive to form into elaborate shapes and inexpensive to assemble into the biased drift pin arrangement. A preferred material is a polymer material.

On the other hand, the leaf spring is preferably formed from a metallic material. Indeed, the leaf spring, including the abutment surface thereof, the retaining lips, and the push and drift pins are stamped from a single piece of planar metal. The abutment surface of the leaf spring is formed from bent tab. The retaining lips or catches are the end-edges of a pair of lateral lips or flanges on the lateral edges of the leaf spring. A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIG. 3 shows an exemplary use for the FIG. 1 embodiment, namely, in an arrangement for coupling separate tubes together; and, FIGS. 4 and 5 show another use, more particularly for the FIG. 2 embodiment, wherein:

DETAILED DESCRIPTION OF THE PREFERRED EMBODIMENTS

Figure 1:
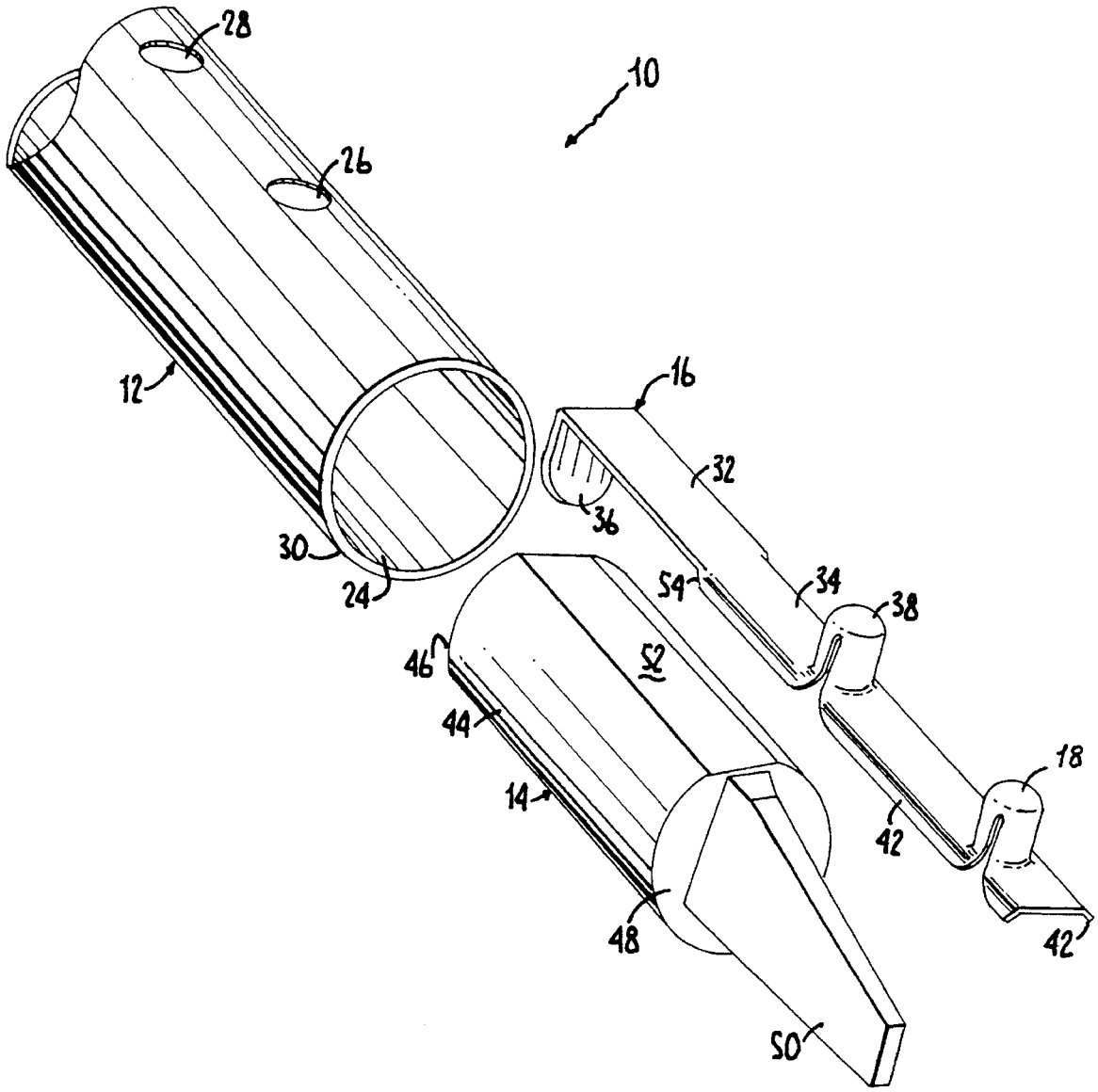
FIG. 1 is an exploded perspective view of a combination tube and biased drift pin in accordance with the invention.
Figure 2:
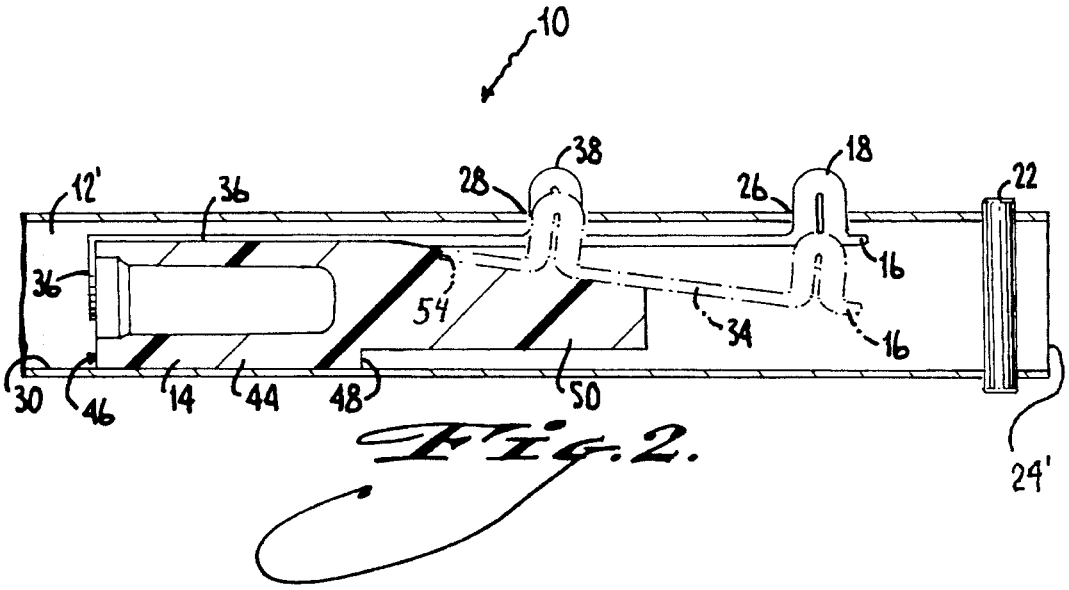
FIG. 2 is a sectional view of an alternate embodiment, taken through a plane of symmetry.

In FIGS. 1 and 2, a combination 10 tube 12' (broken partly away), a cartridge 14, and a leaf spring 16, with an integral drift pin 18, are combinable together in accordance with the invention. FIGS. 1 and 2 depict essentially the same structure except that, in FIG. 2, the tube 12' is arranged a little differently, and carries a transverse pin 22 which has a function described below in connection with FIGS. 4 and 5.

Resuming in FIGS. 1 and 2, the tube 12 is cylindrical, and preferably metal, although this tube 12 is given as an example only for convenience in this description and, accordingly, the given example does not limit the tube to a particular geometry or material. The tube 12 has an end portion terminating in an open end 24 (the opposite end not shown), which end portion 24 is formed with axially-spaced first and second holes 26 and 28. FIG. 2, as said, is slightly different in having another set of holes diametrically opposed from one another for carrying the transverse pin 22. This cylindrical tube 12 is typical for its geometry in having a circular sidewall 30 defining a substantially cylindrical cavity or lumen.

The leaf spring 16 is formed from one piece of planar metal, such as by stamping. The leaf spring 16 is subdividable into a base portion 32 and cantilever portion 34 joined to the base portion 32 for relative angular flexion therebetween. It is desirable that the spring 16 be designed to endure and withstand numerous cycles of flexion. To this end, it is preferable that the base portion 32 and cantilever portion 34 are arranged substantially planar when the spring 16 is in a normal state, or state of extension (FIG. 2 shows the normal state, or state of extension, in solid line). The spring material is thereby relieved of much internal stress, especially at the junction between the cantilever and base portions 34 and 32.

Other design considerations for the spring 16 relate to the method of mounting, described below. The base portion 32 of the spring 16 terminates in a bent-down tab 36. The cantilever portion 34 contains the drift pin 18 and is also formed with a second pin, or a push pin 38, spaced from the drift pin 18 as shown. The cantilever portion 34 further includes opposite lateral edges 42 bent down at an angle.

The cartridge 14 is made from a single piece of a suitable polymeric material (or plastic). Polymeric materials or plastics are desirable because they are relatively inexpensive materials which are relatively inexpensive to form into elaborate shapes. As the cartridge 14 is used here, plastic also has a desirably low coefficient of friction when sliding across metallic surfaces. The cartridge 14 has a generally cylindrical main body 44 that extends between a butt end 46 and a snout end 48, which is formed with a snout 50. The main body 44 is generally sized to complement the inside diameter of the tube 12 for close-fitting engagement with the wall 30 of the tube 12. The main body 44 includes a flat 52, which has a purpose described below.

FIG. 2 shows the tube 12', leaf spring 16 and cartridge 14 after assembly. Assembly optionally comprises the following steps. The leaf spring 16 is inserted into the tube 12' and then arranged until the drift and push pins 18 and 38 are aligned to extend and retract through the first and second holes 26 and 28, respectively. Next the cartridge 14 is advanced into the tube 12' with the butt end 46 leading the advance. The low coefficient of friction eases the advance of the cartridge 14 through the tube 12'. The cartridge 14 is oriented such that the flat 52 will engage and slide under the leaf spring 16 until, as FIG. 2 shows, the butt end 46 of the cartridge 14 hits the bent tab 36 of the leaf spring 16.

The cartridge 14 thus wedges the base portion 32 of the leaf spring 16 relatively immobile against the wall 30 of the tube 12'. This results in the drift and push pins 18 and 38 being normally biased to extend through the first and second holes 26 and 28, respectively (as shown in solid line in FIG. 2). The push pin 38 can be depressed to flex the leaf spring 16 (clockwise in FIG. 2) and induce full retraction of the drift pin 18 out of the first hole 26 (as shown in broken lines in FIG. 2).

The snout 50 is positioned relative to the leaf spring 16, and shaped and arranged to limit the maximum flexion of leaf spring 16 to an angle well within the elastic limit of the material of the leaf spring 16. The push pin 38 is arranged such that it always occupies the second hole 28, whether the spring 16 is in the state of extension (solid line in FIG. 2) or maximum flexion (broken lines in FIG. 2). Thus, an additional function of the push pin 38 is to stabilize the location of the leaf spring 16 and cartridge 14 relative to the tube 12,12'.

In FIG. 1, the bent-down edges 42 of the leaf spring 16 terminate adjacent the base portion 32 of the leaf spring 16 to define retaining lips 54 which in FIG. 2, are disposed against the snout end 48 of the cartridge 14. The cartridge 14 is held captive by the leaf spring 16 between the retaining lips 54 and bent tab 36, acting against the snout and butt ends 48 and 46, respectively. The leaf spring 16 is stabilized in position, or at least prevented from moving axially in the tube 12', by the arrangement of the push pin 38 constantly occupying the second hole 28 for all angles of flexion and/or extension, as previously stated.

The cartridge 14 is desirable because, among other reasons, it is relatively inexpensive hardware for accomplishing the mounting connection between the tube 12, 12' and leaf spring 16. The cartridge 14 is economical to fabricate in elaborate shapes from economy materials, and economical to assemble with the spring 16 and tube 12, 12'. The cartridge and spring are assembled via simply being "popped in", thereby excluding welds or rivets and the like.

Figure 3:
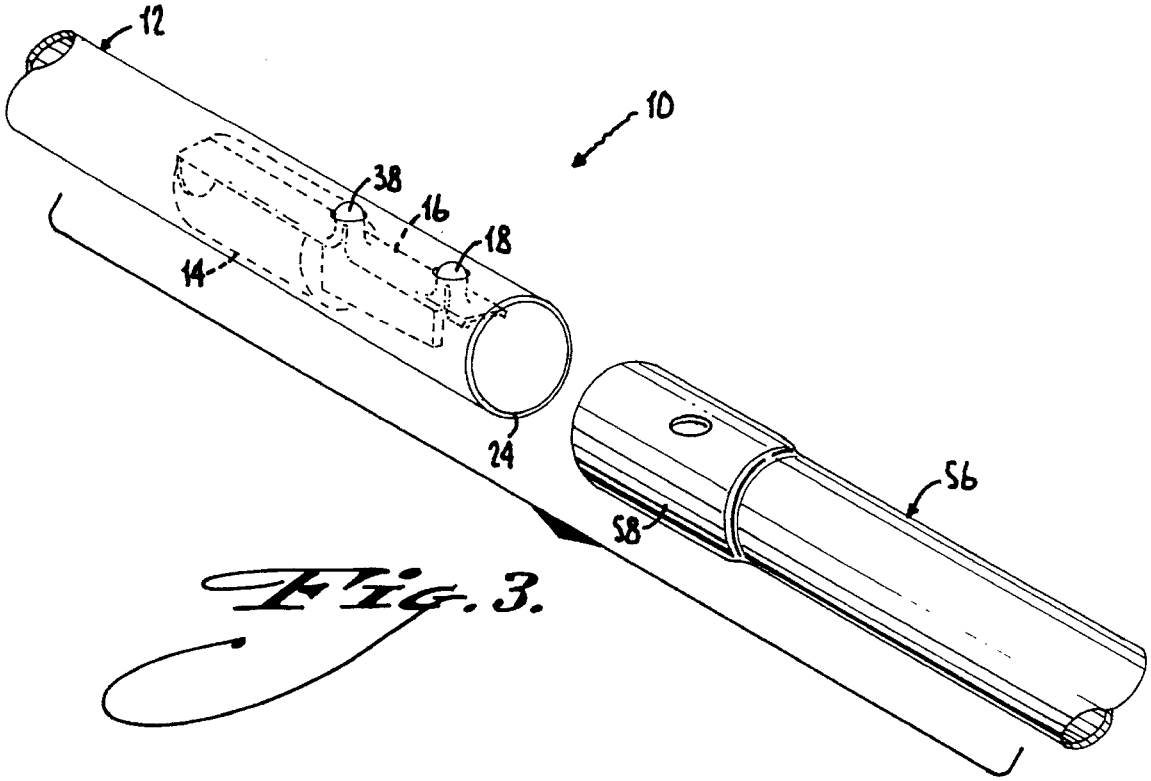

An exemplary use of the tube and biased drift pin combination 10 is shown in FIG. 3, incorporated in an arrangement for coupling separate tubes together. The left (left in FIG. 3) tube 12 is the same as depicted in FIG. 1. The other tube 56 carries a sleeve 58 welded to an end of the tube 56 and formed with one hole for removably receiving the biased drift pin 18. Coupling and decoupling the tubes 12 and 56 involves activating the drift pin 18 via the push pin 38.

Figure 4:
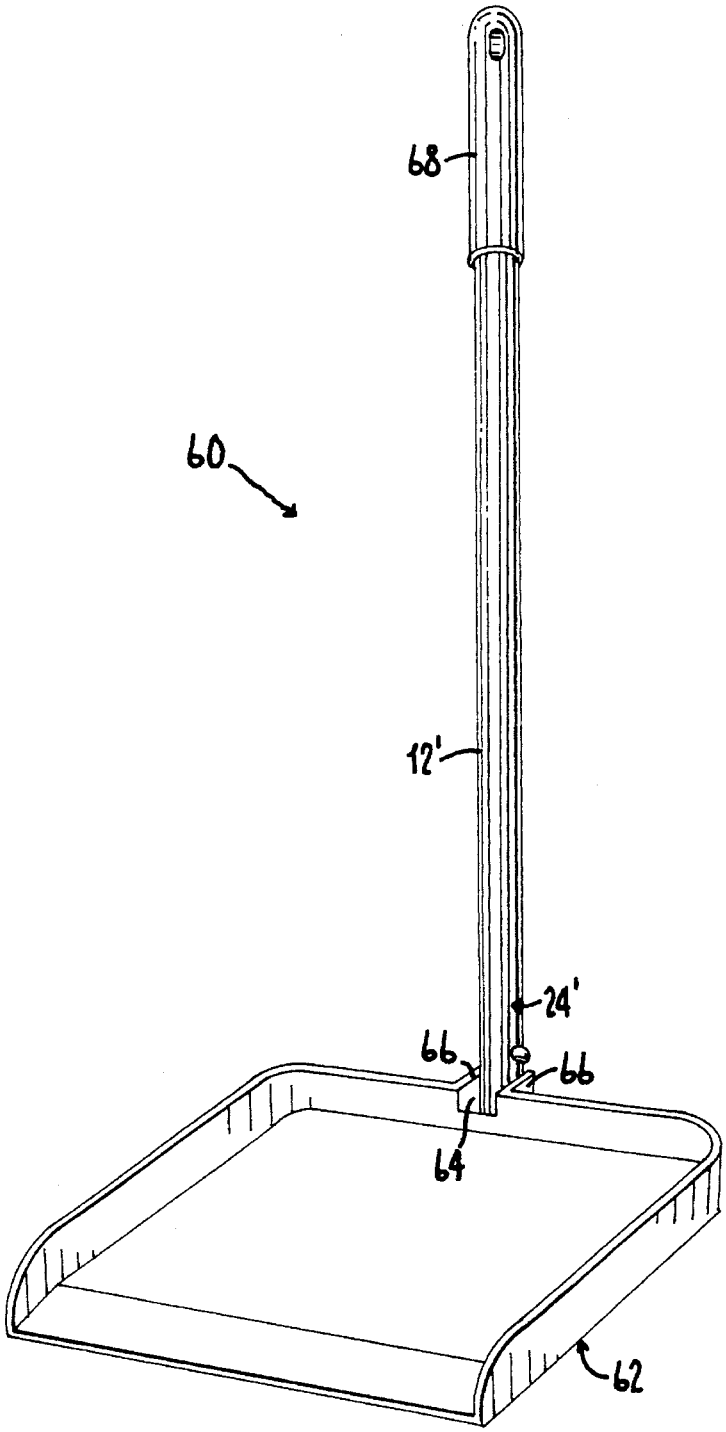
FIG. 4 a perspective view showing a locking hinged-dustpan locked in a state of flexion; and, FIG. 5 is a side elevational view showing the locking hinged-dustpan locked in a state of extension.
Figure 5:
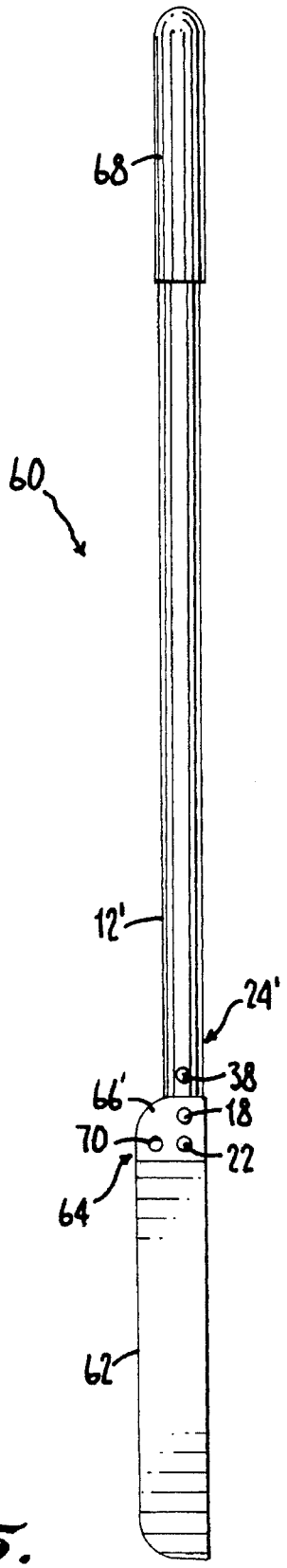

FIGS. 4 and 5 show another exemplary use for the tube and biased drift pin combination 10, namely in a locking hinged-dustpan 60. The locking hinged-dustpan 60 comprises a tubular handle 12' which is arranged as shown in FIG. 2.

The locking hinged-dustpan 60 comprises a pan 62 hinged or pivoted to the tubular handle 12' via the transverse pin 22. The pan 62 is defined by a bottom that has front and rear edges spaced between side edges, and a rear and two side flanges extending upwardly from the rear and side edges, respectively. The front edge defines a scoop across which dust or debris can be swept. The rear flange is formed with a bracket portion 64, and this bracket portion 64 is characterized by a pair of spaced sidewalls 66.

The tubular handle 12' extends between a bottom end 24' and an upper end 68, which includes a hand grip portion. The bottom end 24' is pivotably connected to the bracket portion 64 via the pivot pin 22 (FIGS. 2 and 5) extending between and anchored in the opposite sidewalls 66. The pivot pin 22 defines a pivot axis that extends perpendicular to the bracket sidewalls 66, generally parallel to the rear flange of the pan 62.

FIG. 5 shows that the near (near in FIG. 5) sidewall 66' of the bracket portion 64 is formed with two locking holes 70 (i.e., other than the hole occupied by the pivot pin 22). These locking holes 70 are arranged in the bracket sidewall 66' for retractably receiving the drift pin 18 to define at least two locked positions for the handle 12' relative to the pan 62. One locked position being, for example, in a state of extension (FIG. 5), and the other a state of flexion (i.e., in FIG. 4, flexion to a right angle).

In use, depression of the push pin 38 induces retraction of the drift pin 18 in one or the other of the locking holes 70, thereby by permitting pivoting of the handle 12' relative to the pan 62. The handle 12' and pan 62 can thereafter be locked in a given state of flexion or extension by aligning the drift pin 18 to occupy the chosen locking hole 70, and then releasing the push pin 38.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. In combination, a tube and biased drift pin, comprising:

the tube having a wall formed with two axially-spaced holes;

a leaf spring that has a base portion and a cantilever portion joined to the base portion for relative flexion therebetween, the base portion being formed with an abutment surface and the cantilever portion being arranged to carry the drift pin as well as a spaced push pin; and, a separate cartridge formed with an abutment surface;

said leaf spring being disposed in the tube with the drift and push pins aligned to extend and retract through respective ones of the axially-spaced holes;

said cartridge being sized and shaped to permit sliding insertion in the tube relative to the leaf spring to a stationary position where the respective abutment surfaces are mated and the cartridge wedges the base portion of the leaf spring relatively immobile against the tube wall such that the push and drift pins are normally biased to extend through the respective holes and that the push pin can be depressed to induce full retraction of the drift pin;

wherein the leaf spring is maintained from moving axially in the tube by the arrangement of the push pin constantly occupying its respective hole for all angles of flexion and extension of the cantilever portion, the leaf spring further including retaining means for retaining the cartridge in said stationary position.

2. The combination in claim 1, wherein the cartridge has a body extending between opposite edges, one of which defines the abutment surface for the cartridge and the other being acted on by the retaining means of the leaf spring such that the cartridge is captive between the retaining means and abutment surface that are both on the leaf spring.

3. The combination in claim 2, wherein the retaining means comprises a protrusion formed and arranged to act operatively on the respective edge of the cartridge.

4. The combination in claim 1, wherein the base portion of the leaf spring is elongated and generally planar between opposite lateral edges, said cartridge being formed with a flat surface to abut against the base portion, the flat surface being sized to induce the wedging of the base portion against the tube by inducing the lateral edges thereof against an inside surface of the tube.

5. The combination in claim 1, wherein the cartridge is formed from a polymer material.

6. The combination in claim 1, wherein the leaf spring, including the abutment surface thereof, and the push and drift pins are stamped from a single piece of planar metal.

7. The combination in claim 6, wherein the retaining means of the leaf spring comprises at least one bent flange of metal, positioned axially-spaced from the abutment surface of the leaf spring.

8. The combination in claim 6, wherein the retaining means and abutment surface that are both of the leaf spring comprise respective bent portions of the leaf spring.

9. A locking hinged-dustpan, comprising:

a pan having a bottom that has front and rear edges spaced between side edges, a rear flange and two side flanges extending upwardly from the rear and side edges respectively, wherein the front edge defines a scoop;

a bracket on the rear flange having at least one sidewall;

a handle formed from a tube having a wall extending between opposite end portions, one end portion being pivotably connected to the bracket to pivot about an axis generally perpendicular to the bracket sidewall, said one end portion including two axially spaced holes, the opposite end portion being arranged as a hand grip;

a leaf spring that has a base portion and a cantilever portion joined to the base portion for relative flexion therebetween, the base portion being formed with an abutment surface;

a drift pin and spaced push pin arranged and fixed on the cantilever portion; and, a separate cartridge, formed with an abutment surface;

said leaf spring being arranged in the handle tube with the drift and push pins aligned to extend and retract through respective ones of the axially spaced holes;

said cartridge being sized and shaped to permit sliding insertion in the handle tube relative to the leaf spring to a stationary position where the respective abutment surfaces are mated and the cartridge wedges the base portion of the leaf spring relatively immobile against the tube wall such that the push and drift pins are normally biased to extend through the respective holes and that the push pin can be depressed to induce full retraction of the drift pin;

wherein the leaf spring is maintained from moving axially in the tube by the arrangement of the push pin constantly occupying its respective hole for all angles of flexion and extension of the cantilever portion, the leaf spring further including retaining means for retaining the cartridge in said stationary position.

10. The locking hinged-dustpan in claim 9, wherein the cartridge has a body extending between opposite edges, one of which defines the abutment surface for the cartridge and the other being acted on by the retaining means of the leaf spring such that the cartridge is captive between the retaining means and abutment surface that are both on the leaf spring.

11. The locking hinged-dustpan in claim 10, wherein the retaining means comprises a protrusion formed and arranged to act operatively on the respective edge of the cartridge.

12. The locking hinged-dustpan in claim 9, wherein the base portion of the leaf spring is elongated and generally planar between opposite lateral edges, said cartridge being formed with a flat surface to abut against the base portion, the flat surface being sized to induce lateral edges of the base portion to wedge against the tube wall.

13. The locking hinged-dustpan in claim 9, wherein the cartridge is formed from a polymer material.

14. The locking hinged-dustpan in claim 9, wherein the leaf spring, including the abutment surface thereof, and the push and drift pins are stamped from a single piece of planar metal.

15. The locking hinged-dustpan in claim 14, wherein the retaining means of the leaf spring comprises at least one bent flange of metal, positioned axially-spaced from the abutment surface of the leaf spring.

16. The locking hinged-dustpan in claim 14, wherein the retaining means and abutment surface that are both of the leaf spring comprise respective bent portions of the leaf spring.

* * * * *